US010358705B2

(12) United States Patent
Bao et al.

(10) Patent No.: US 10,358,705 B2
(45) Date of Patent: Jul. 23, 2019

(54) POLYCRYSTALLINE DIAMOND SINTERED/REBONDED ON CARBIDE SUBSTRATE CONTAINING LOW TUNGSTEN

(71) Applicant: Smith International, Inc., Houston, TX (US)

(72) Inventors: Yahua Bao, Orem, UT (US); Fulong Wang, Pleasant Grove, UT (US); J. Daniel Belnap, Lindon, UT (US); Ronald K. Eyre, Orem, UT (US); Yi Fang, Orem, UT (US)

(73) Assignee: SMITH INTERNATIONAL, INC., Houston, TX (US)

( * ) Notice: Subject to any disclaimer, the term of this patent is extended or adjusted under 35 U.S.C. 154(b) by 27 days.

(21) Appl. No.: 15/536,826

(22) PCT Filed: Nov. 20, 2015

(86) PCT No.: PCT/US2015/061768

§ 371 (c)(1),
(2) Date: Jun. 16, 2017

(87) PCT Pub. No.: WO2016/099798

PCT Pub. Date: Jun. 23, 2016

(65) Prior Publication Data

US 2018/0044764 A1 Feb. 15, 2018

Related U.S. Application Data

(60) Provisional application No. 62/092,967, filed on Dec. 17, 2014.

(51) Int. Cl.

*B22F 3/14* (2006.01)
*C22C 1/10* (2006.01)
(Continued)

(52) U.S. Cl.

CPC ..... *C22C 26/00* (2013.01); *B22F 3/14* (2013.01); *B22F 5/00* (2013.01); *C22C 1/1036* (2013.01);
(Continued)

(58) Field of Classification Search

None
See application file for complete search history.

(56) References Cited

U.S. PATENT DOCUMENTS 7,647,992 B2 1/2010 Fang et al.
7,776,256 B2 8/2010 Smith et al.
(Continued)

FOREIGN PATENT DOCUMENTS

EP 2401099 A1 1/2012
GB 2276896 A 10/1994
WO 0224601 A1 3/2002

OTHER PUBLICATIONS

International Search Report and Written Opinion issued in International application PCT/US2015/061768 dated Feb. 22, 2016. 13 pages.
(Continued)

*Primary Examiner* — Colleen P Dunn
*Assistant Examiner* — Ross J Christie

(57) ABSTRACT

A method of forming a polycrystalline diamond cutting element includes assembling a diamond material, a substrate, and a source of catalyst material or infiltrant material distinct from the substrate, the source of catalyst material or infiltrant material being adjacent to the diamond material to form an assembly. The substrate includes an attachment material including a refractory metal. The assembly is subjected to a first high-pressure/high temperature condition to cause the catalyst material or infiltrant material to melt and infiltrate into the diamond material and subjected to a
(Continued)

second high-pressure/high temperature condition to cause the attachment material to melt and infiltrate a portion of the infiltrated diamond material to bond the infiltrated diamond material to the substrate.

13 Claims, 18 Drawing Sheets

(51) Int. Cl.
*C22C 26/00* (2006.01)
*E21B 10/573* (2006.01)
*B22F 5/00* (2006.01)

(52) U.S. Cl.
CPC .... *E21B 10/5735* (2013.01); *B22F 2005/001* (2013.01); *B22F 2302/406* (2013.01); *C22C 2026/006* (2013.01)

(56) References Cited

U.S. PATENT DOCUMENTS

| | | | | |
|---|---|---|---|---|
| 8,087,324 | B2 | 1/2012 | Eason et al. | |
| 8,590,130 | B2 | 11/2013 | Zhang et al. | |
| 8,663,349 | B2 | 3/2014 | Sani et al. | |
| 9,091,131 | B2 | 7/2015 | Yu et al. | |
| 2004/0007394 | A1 | 1/2004 | Griffin | |
| 2006/0162969 | A1* | 7/2006 | Belnap | B22F 7/06 175/433 |
| 2006/0266558 | A1* | 11/2006 | Middlemiss | B22F 7/062 175/426 |
| 2007/0144790 | A1 | 6/2007 | Fang et al. | |
| 2008/0101977 | A1 | 5/2008 | Eason et al. | |
| 2009/0095538 | A1 | 4/2009 | Middlemiss | |
| 2010/0012389 | A1 | 1/2010 | Zhang et al. | |
| 2011/0036643 | A1* | 2/2011 | Belnap | C22C 26/00 51/295 |
| 2011/0061944 | A1 | 3/2011 | Scott et al. | |
| 2012/0138370 | A1 | 6/2012 | Mukhopadhyay et al. | |
| 2012/0151848 | A1 | 6/2012 | Suryavanshi | |
| 2013/0009245 | A1 | 1/2013 | Chang et al. | |
| 2013/0092452 | A1 | 4/2013 | Mukhopadhyay et al. | |
| 2013/0264124 | A1* | 10/2013 | Belnap | B01J 3/06 51/295 |
| 2014/0059943 | A1 | 3/2014 | Flood et al. | |
| 2014/0060938 | A1 | 3/2014 | Bellin et al. | |
| 2014/0087120 | A1 | 3/2014 | Sagl et al. | |
| 2014/0123562 | A1 | 5/2014 | Voronin | |

OTHER PUBLICATIONS

Katzman et al. Sintered Deamond Compacts with a colbalt binder. Science. vol. 172 (3988): 1132-4. Jun. 11, 1971.

Hong et al., Behaviour of cobalt infiltration and abnormal grain growth during sintering of diamond on cobalt substrate. Journal of Materials Science. vol. 23 1988. pp. 3821-3826.

Uehara et al., High Pressure Sintering of Diamond by Cobalt Infiltration. Science and Technology of New Diamond. 1990. pp. 203-209.

Jai, et al., Synthesis of growth-type polycrystalline diamond compact (PDC) using the tolvent Fe55Ni29Co16 alloy under HPHT. Science China Physics, Mechanics and Astronomy. Science China Press and Springer-Verlag Berlin Heidelberg 2012. pp. 1394-1398.

Li et al., Relationships between feedstock structure, particle parameter, coating deposition, microstructure and properties for thermally sprayed conventional and nanostructured WC—Co. International Journal of Refractory Metals and Hard Materials. vol. 39. 2013. pp. 2-17.

Konyashin et al., A novel sintering technique for fabrication of functionally gradient WC—Co cemented carbides. Journal of Materials Science. vol. 47(20). 2012. pp. 7072-7084.

International Preliminary Report on Patentability issued in International Patent Application PCT/US2015/061768 dated Jun. 20, 2017, 9 pages.

First Office Action and Search Report issued in Chinese patent application 201580075173.2 dated Oct. 29, 2018, 12 pages.

* cited by examiner

POLYCRYSTALLINE DIAMOND SINTERED/REBONDED ON CARBIDE SUBSTRATE CONTAINING LOW TUNGSTEN

CROSS REFERENCE TO RELATED APPLICATION

This Application claims the benefit of and priority to U.S. Provisional Application 62/092,967 filed on Dec. 17, 2014, the entirety of which is incorporated herein by reference.

BACKGROUND

Polycrystalline diamond compact (PDC) cutters and diamond enhanced inserts (DEIs) have been used in industrial applications including rock drilling and metal machining for many years. Generally, a compact or layer of polycrystalline diamond (PCD) (or other superhard material) is bonded to a substrate material, such as a sintered metal-carbide, e.g., cemented tungsten carbide, to form a cutting structure. PCD generally includes a polycrystalline mass of diamonds that are bonded together to form an integral, tough, high-strength mass or lattice. The resulting PCD structure has enhanced wear resistance and hardness, making PCD materials useful in wear and cutting applications where high levels of wear resistance and hardness are desired.

A PDC cutter or DEI may be formed by placing a cemented carbide substrate into the container of a press. A mixture of diamond particles or diamond powder is placed atop the substrate and treated under high-pressure high-temperature (HPHT) conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn bonded to the substrate. The substrate often includes a metal-carbide composite material, such as tungsten carbide. The deposited diamond layer is often referred to as the "diamond table" or "abrasive layer." The term "particle" refers to the powder employed prior to sintering a superabrasive material, while the term "grain" refers to discernable superabrasive regions subsequent to sintering.

Generally, PCD may include any suitable amount of diamond and binder, e.g., from 85 to 95% by volume diamond and a balance of the binder material, the binder being present within the interstices existing between the bonded diamond grains. Binder materials used for forming conventional PCD include metals from Group VIII of the Periodic Table, such as cobalt, iron, or nickel and/or mixtures or alloys thereof. Higher metal content increases the toughness of the resulting PCD material, but may also decrease the PCD material hardness, thus making it difficult to improve both hardness and toughness. Similarly, when variables are selected to increase the hardness of the PCD material, brittleness may also increase, thereby reducing the toughness of the PCD material.

SUMMARY

This summary is provided to introduce a selection of concepts that are further described below in the detailed description. This summary is not intended to identify key or essential features of the claimed subject, nor is it intended to be used as an aid in limiting the scope of the claimed subject matter.

In one aspect, embodiments of the present disclosure relate to a method of forming a polycrystalline diamond cutting element that includes assembling a diamond material, substrate, and a source of catalyst material or infiltrant material distinct from the substrate, the source of catalyst or infiltrant being adjacent to the diamond material to form an assembly. The substrate may include an attachment material including a refractory metal. The method may further include subjecting the assembly to a first high-pressure/high-temperature condition to cause the catalyst material or infiltrant material to melt and infiltrate into the diamond material and subjecting the assembly to a second high-pressure/high-temperature condition to cause the attachment material to melt and infiltrate a portion of the infiltrated diamond material to attach the infiltrated diamond material to the substrate.

In another aspect, embodiments of the present disclosure relate to a cutting element that includes a polycrystalline diamond layer on a refractory metal carbide substrate, the polycrystalline diamond layer including at least two regions: a first region remote from the substrate and including a plurality of bonded together diamond grains, a plurality of interstitial regions interposed between the bonded together diamond grains, the interstitial regions including less than 1 wt % refractory metal based on the total weight of the first region; and a second region adjacent to the substrate and including a plurality of bonded together diamond grains, a plurality of interstitial regions interposed between the bonded together diamond grains, the interstitial regions including a Group VIII metal and a refractory metal.

BRIEF DESCRIPTION OF DRAWINGS

Embodiments of the present disclosure are described with reference to the following figures. The same numbers are used throughout the figures to reference like features and components.

DETAILED DESCRIPTION

Embodiments disclosed herein generally relate to methods and materials used for improving the fracture toughness of polycrystalline diamond bodies. Embodiments disclosed herein also relate to polycrystalline diamond bodies having low tungsten content and cutting structures including the same.

In some embodiments, polycrystalline ultra-hard materials may be formed using a catalyst or infiltrant material that is provided from a source other than the substrate. That is, polycrystalline ultra-hard materials may be formed from diamond powder infiltrated with the catalyst originating from a source other than the substrate or a preformed sintered diamond body may be infiltrated with an infiltrant material originating from a source other than the substrate to which the preformed diamond body is being attached. In both scenarios, the infiltration (of catalyst or infiltrant) may occur in an HPHT sintering cycle that first infiltrates the catalyst/infiltrant into the diamond material (powder or preformed sintered body) and subsequently attaches the diamond material to a substrate.

The term "catalyst" is used to indicate when a material catalyzes diamond powder to form a PCD body (having interconnected diamond grains) while "infiltrant" is used to indicate when a material infiltrates into a PCD body but does not catalyze it, i.e., the material infiltrates into a previously formed PCD body. In the latter case, where an infiltrant is used, the catalyst material used to form the PCD body may be removed from the body (resulting in substantially empty voids or interstitial regions between the diamond grains) prior to allowing the infiltrant material to infiltrate into the PCD body. By using a catalyst or infiltrant provided from a source other than a substrate, a top surface/region of the resulting PCD body opposite the substrate may have a lower tungsten content than a conventional PCD structure. In addition, the term "attachment material" is used to indicate when a material infiltrates into a PCD body from the substrate to attach the substrate to the PCD body. Each of the catalyst, infiltrant, and attachment material may include the same or different materials. For example, cobalt could be included in each of the catalyst, infiltrant, and attachment materials. As will be discussed in detail below, in some embodiments, the attachment material differs from the catalyst or infiltrant in that it generally carries a relatively larger amount of tungsten or other metal from the substrate.

Figure 1:
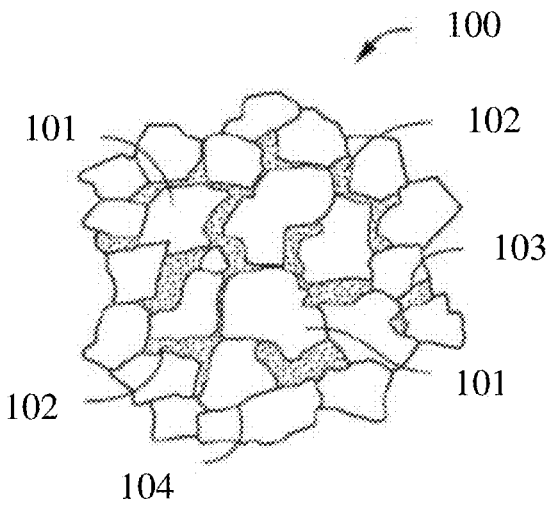
FIG. 1 shows the microstructure of a conventionally formed polycrystalline diamond.

According to embodiments of the present disclosure, a cutting element may include a PCD layer bonded to a refractory metal carbide substrate. FIG. 1 schematically illustrates a microstructure of PCD material 100. As illustrated, PCD material 100 includes a plurality of diamond grains 101 that are bonded to one another to form an intercrystalline diamond matrix. The catalyst or binder 102, e.g., cobalt, used to facilitate the diamond-to-diamond bonding that develops during the sintering process is dispersed within the interstitial regions formed between the diamond matrix first phase. While not shown in FIG. 1, and as described above, the catalyst material 102 may be removed and replaced with an infiltrant material. The microstructure of the PCD material 100 may have a uniform distribution of binder among the PCD grains. PCD material may include diamond grain/binder interfaces 103 and diamond grain/diamond grain interfaces 104.

In one or more embodiments, the interstitial regions may have a non-uniform amount of refractory metal distributed through the PCD layer. For example, a portion of the diamond layer remote from the substrate may have a lower amount of refractory metal (infiltrated from the substrate during the attachment of the substrate to the diamond layer) than a portion of the diamond layer proximate the interface with the substrate. The difference in the amount of refractory metal present in the polycrystalline diamond layer may result from the use of a catalyst or infiltrant material that originates from a source other than the substrate. By using a source other than the substrate, a more pure catalyst or infiltrant may infiltrate through the diamond material and fill or occupy the interstitial regions. However, because the diamond layer is also being attached to a substrate by HPHT sintering, an amount of refractory metal may be carried into the diamond layer during the attachment.

In one or more embodiments, the catalyst or infiltrant material is a metal or a metal alloy selected from Group VIII of the Periodic Table, and may be provided as a powder or a structure (e.g., a foil disc or ring), for example. When provided as a powder, the metal powder may optionally be mixed with diamond powder or carbon. However, other infiltrant materials (i.e., materials other than a Group VII element) may also be used.

In one or more embodiments, a method of making a polycrystalline diamond body may include placing a substrate, a diamond material, and a catalyst or infiltrant material other than the substrate in a sintering container. The diamond material may include diamond powder or a preformed sintered diamond body. The catalyst or infiltrant material may be provided in the form of a distinct layer or a foil placed adjacent to the diamond material and opposite the substrate, or may be pre-mixed with diamond powder and placed as a transition layer between the substrate and the diamond material. During the sintering process, the diamond material may first be prefilled or infiltrated with the catalyst or infiltrant material, making infiltration of metal provided from the substrate into the diamond layer (i.e., the attachment material) more difficult (e.g., in a tungsten carbide substrate, the infiltration with the catalyst or infiltrant makes further infiltration of tungsten more difficult, reducing the amount of tungsten in the diamond layer). In some embodiments, as a result of the location of the catalyst or infiltrant, a surface region of the polycrystalline diamond layer opposite the substrate may contain a relatively low content of tungsten. For example, there may be at least 1.5, 2 or even 3 times more tungsten in the PCD layer adjacent to the interface with the substrate compared to the remote surface of the PCD layer (opposite the substrate). In one or more embodiments, the PCD at the remote surface may have a tungsten content of less than about 5 wt %, about 2 wt %, about 1.5 wt %, about 1 wt %, about 0.5 wt %, or no tungsten may be present. In one or more embodiments, the PCD at the surface adjacent to the substrate may be greater than the amount of tungsten at the working surface, and may, e.g., have a tungsten content of about 0.5 wt % to about 10 wt %, about 0.6 wt % to about 5 wt %, 1 wt % to about 5 wt %, 2 wt % to about 3 wt %, or any other suitable amount.

The assembly may be sintered together by subjecting the layers to HPHT conditions, such as pressures in the range from 4 GPa to 7 GPa or greater, and temperatures of about 1100° C. to 2000° C. for a sufficient period of time. In one or more embodiments, the sintering cycle may be tailored to allow for infiltration of the catalyst or infiltrant material (originating from a source other than the substrate) prior to melting of the metal from the substrate, such as by holding the sintering conditions to a temperature that is less than the temperature at which the metal from the substrate would infiltrate into the diamond material. That is, a first HPHT sintering condition may be applied to promote infiltration of the catalyst or infiltrant material into the diamond layer for a period of time prior to ramping to a second HPHT sintering condition. According to various embodiments, during the second sintering HPHT condition, a metal binder (such as for example cobalt, or other metal) provided from the substrate may melt and infiltrate the diamond layer, promoting bonding of the infiltrated polycrystalline diamond layer to the substrate.

Figure 2:
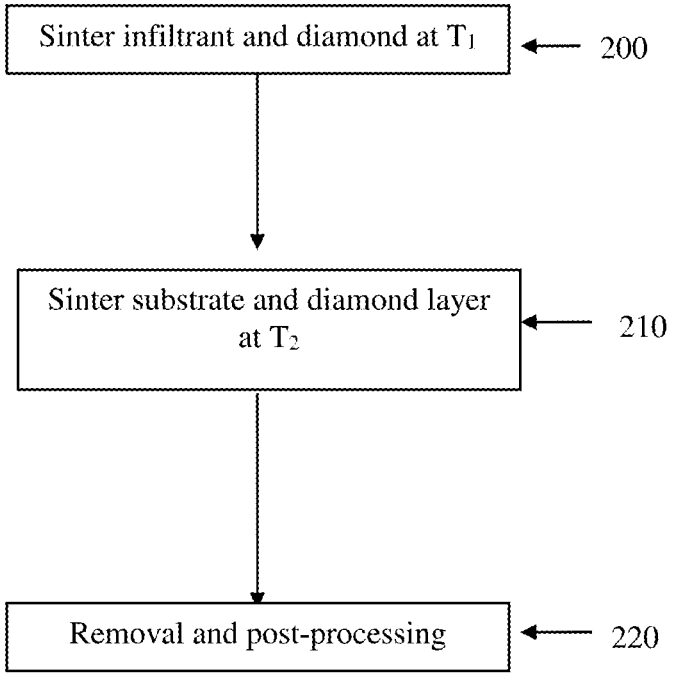
FIG. 2 shows a flowchart for forming polycrystalline diamond bodies according to embodiments of the present disclosure.

As shown in the flowchart of FIG. 2, a catalyst or infiltrant material (such as pure cobalt, Co/C, or cobalt powder) and a layer of diamond is sintered at $T_1$ (200). The temperature of $T_1$ is selected based on the nature of the catalyst or infiltrant (e.g., melting temperature) to allow the infiltrant to flow into the diamond material. Then, the temperature is raised to $T_2$ to allow the substrate to bond to the diamond material (210) by allowing the flow of the attachment material from the substrate into the diamond material. Next, the bonded body may be removed and subjected to various post-processing treatments (220).

According to embodiments of the present disclosure, the temperature of the second HPHT sintering condition is higher than the temperature of the first HPHT sintering condition. In one or more embodiments, the temperature of the first HPHT condition is about 1100° C. to about 1360° C. (or, e.g., about 1200° C. to about 1360° C. or about 1250° C. to about 1360° C.). In one or more embodiments, the temperature of the second HPHT sintering condition is about 1300° C. to about 1600° C. (or, e.g., about 1360° C. to about 1600° C. or about 1400° C. to about 1600° C.). In embodiments, the pressure of the first and second HPHT sintering condition is greater than 4.5 GPa. While particular pressure and temperature ranges for the HPHT sintering conditions have been provided, it is to be understood that such processing conditions can and will vary depending on such factors as the type and/or amount of infiltrant material used.

After the HPHT process is completed, the assembly including the bonded together PCD body and the substrate is removed from the sintering container. The PCD bodies of the present disclosure may be optionally subjected to one or more additional processes. In one or more other embodiments, at least partial removal of the catalyst or infiltrant material may be performed after attaching the PCD body to a substrate. That is, depending on the end use of the cutting element (e.g., temperatures expected) and the type of the catalyst or infiltrant material used, it may be desirable to remove at least a portion of the catalyst or infiltrant material from the interstitial regions of the polycrystalline diamond layer, particularly from the working surface of the diamond layer, opposite the substrate. The catalyst or infiltrant material may be removed as described in more detail below.

Figure 3:
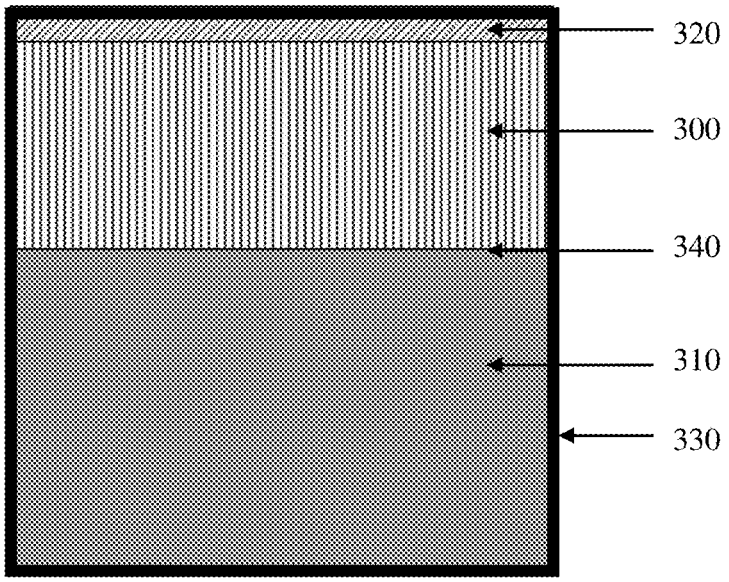
FIG. 3 shows a diagram for forming polycrystalline diamond bodies according to embodiments of the present disclosure.

FIG. 3 schematically illustrates an example of an assembly of components used for making a polycrystalline diamond body according to some embodiments of the present disclosure. As shown, a substrate 310, e.g., cobalt cemented tungsten carbide, is contained in a sintering container 330. In addition, a diamond material 300, e.g., diamond powder, is on top of the substrate 310. A catalyst layer 320, such as a cobalt metal foil, is adjacent to the diamond material 300, and opposite the substrate 310. As discussed, when a catalyst is used, the catalyst may be provided in the form of a metal or alloy foil, a powder of a pure metal catalyst or alloy, or as a metal powder or alloy and carbon mixture. While FIG. 3 illustrates a planar interface between the substrate and the diamond material 300, a non-planar interface may be used as is known in the art. Similarly, while a planar top working surface of the diamond material 300 is shown, a non-planar working surface may also be used.

Upon subjecting the assembly to a first HPHT sintering condition, the catalyst melts and infiltrates into the diamond material to promote intercrystalline diamond-to-diamond bonding between adjacent diamond crystals to form a network or matrix phase of diamond-to-diamond bonding. The catalyst may fully infiltrate the diamond material, occupying the plurality of interstitial regions dispersed between the bonded together diamond grains. The temperature of the first HPHT sintering condition is selected so that the catalyst melts and infiltrates into the diamond materials before at least some materials provided from the substrate, such as Co containing dissolved tungsten and/or carbon, melt and infiltrate into the diamond materials. Therefore, relatively little material from the substrate moves into the diamond material during this stage of the sintering cycle. During the first HPHT sintering condition, the catalyst 320, e.g., Co, dissolves and forms a Co—C eutectic liquid. The cobalt binder provided from the substrate 310 (containing dissolved tungsten and carbon) may melt during the first HPHT condition and form a W—Co—C liquid. However, in some embodiments, the W—Co—C liquid from the substrate may not infiltrate into the diamond materials during the first HPHT sintering condition. This may be due to low viscosity and high surface tension of the W—Co—C liquid relative to the Co—C liquid of the catalyst layer.

After holding the assembly under the first HPHT sintering condition for a period of time, e.g., from about 0.1 minutes to about 10 minutes, the assembly is further subjected to a second HPHT sintering condition at a higher temperature. Due to the higher temperature of the second HPHT sintering condition, the W—Co—C liquid (i.e., the attachment material from the substrate) infiltrates the diamond layer. However, because the polycrystalline diamond body formed during the first HPHT sintering condition is prefilled with the catalyst (which entered during the first HPHT sintering condition), it is difficult for the liquid from the substrate to infiltrate the diamond material 300. Therefore, the W—C—Co liquid may migrate from the substrate 310 and infiltrate the diamond material 300 to a much lower depth along the interface 340 than in conventional sintering. The Co migration from the substrate (e.g., the W—C—Co liquid that migrates from the substrate) promotes attachment of the substrate 310 to the resulting PCD layer. However, because the W—C—Co liquid does not infiltrate throughout the whole diamond material 300, or because significantly less of the liquid infiltrates through to the top surface of the PCD layer, a top surface of the PCD layer opposite the substrate 310 may be substantially free of tungsten.

According to various embodiments, the infiltration depth of tungsten (or other refractory metals) from the substrate into the polycrystalline diamond layer may be less than about 1000, 800, 600, or 400 micrometers, or may range in various embodiments from about 200 micrometers to about 800 micrometers, about 400 micrometers to about 800 micrometers, or about 400 micrometers to about 600 micrometers. In some embodiments, the infiltration depth of tungsten from the substrate in the polycrystalline diamond layer may vary from 10% to 50% of the thickness of the PCD layer or 20% to 40%, or 25% to 33% of the thickness of the PCD layer.

Figure 4:
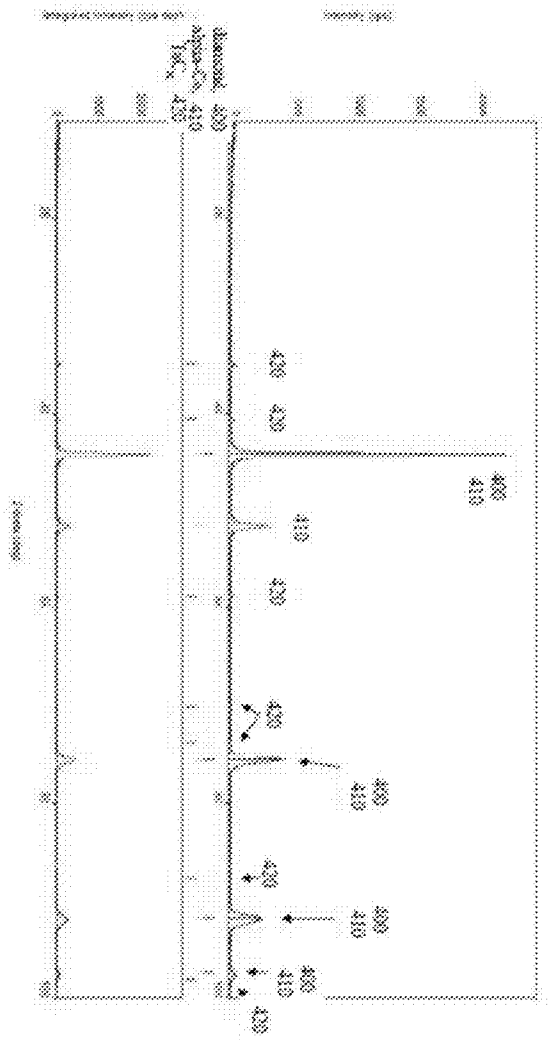
FIG. 4 shows the X-ray powder diffraction of a top surface of a polycrystalline diamond body according to embodiments of the present disclosure.

The amount of refractory metal that infiltrates into the polycrystalline diamond layer may be analyzed by X-ray diffraction. For example, an X-ray analysis was carried out to determine if infiltration of W—Co—C liquid from the substrate into the sintered polycrystalline diamond occurred. X-ray powder diffraction (XRD) on a surface of a sample of sintered PCD opposite the substrate, made according to embodiments of the present disclosure, was performed, as shown in FIG. 4. No WC was detected on the surface of the sintered polycrystalline diamond opposite the substrate, indicating that none of the W—Co—C liquid from the substrate infiltrated to the surface of the PCD opposite the substrate. However, a residual amount of a refractory metal carbide on a surface of the sintered polycrystalline diamond opposite the substrate (e.g., tantalum carbide) resulting from the sintering container was also detected by XRD. For example, as seen in FIG. 4, tantalum carbide may be detected when a tantalum sintering container is used. As such, the X-ray powder diffraction of a surface of the sintered polycrystalline diamond opposed to the substrate indicates a few weak peaks 420 which correspond to tantalum carbide, $TaC_x$. The very low intensity of these peaks compared with the peaks corresponding to diamond 400 and cobalt 410, is an indication that tantalum carbide is present as a minor phase, in an amount of less than 0.4 wt %. A polycrystalline diamond layer that possesses such tantalum carbide (or other refractory metals) arising from the sintering container at the working surface may still be considered to be substantially free of refractory metal (i.e., free of refractory metal provided from the substrate). Furthermore, as noted above, none of the refractory metal from the substrate, e.g., tungsten, was found at the surface of the PCD opposite the substrate.

Figure 5:
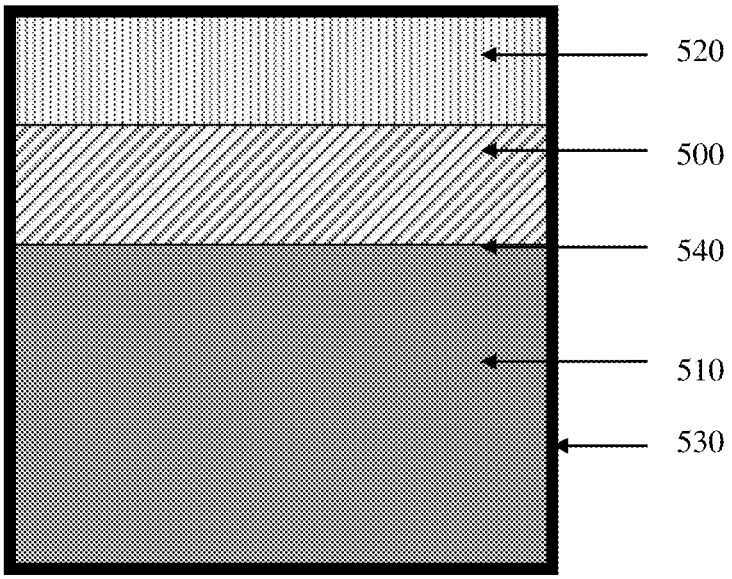
FIG. 5 shows a diagram for forming polycrystalline diamond bodies according to embodiments of the present disclosure.

According to some embodiments, the catalyst may be pre-mixed with diamond powder and placed as a transition layer between the substrate and the diamond material. For example, referring now to FIG. 5, a substrate 510 is in a sintering container 530. A transition layer 500 including a catalyst pre-mixed with diamond powder, is adjacent to the substrate 510. A diamond powder layer 520 is adjacent to the transition layer 500. The transition layer 500 is distinct from the diamond powder layer 520. The transition layer may include other constituents such as a refractory metal, or metal carbide, nitride, oxide, or boride substance present in an amount ranging from about 5 vol % to about 80 vol % (e.g., about 15 vol % to about 65 vol %, about 30 vol % to about 50 vol %) which may make the layer intermediate in elastic and thermal properties between the PCD and the substrate material. In one or more embodiments, the amount of the catalyst included in the transition layer ranges from about 10 wt % to about 50 wt % based on the total weight of the transition layer. However, the catalyst may be included in any suitable amount, such as about 5 wt % to about 70 wt %, or from about 10 wt % to about 50 wt %, or from about 10 wt % to 30 wt % based on the total weight of the transition layer.

Figure 6:
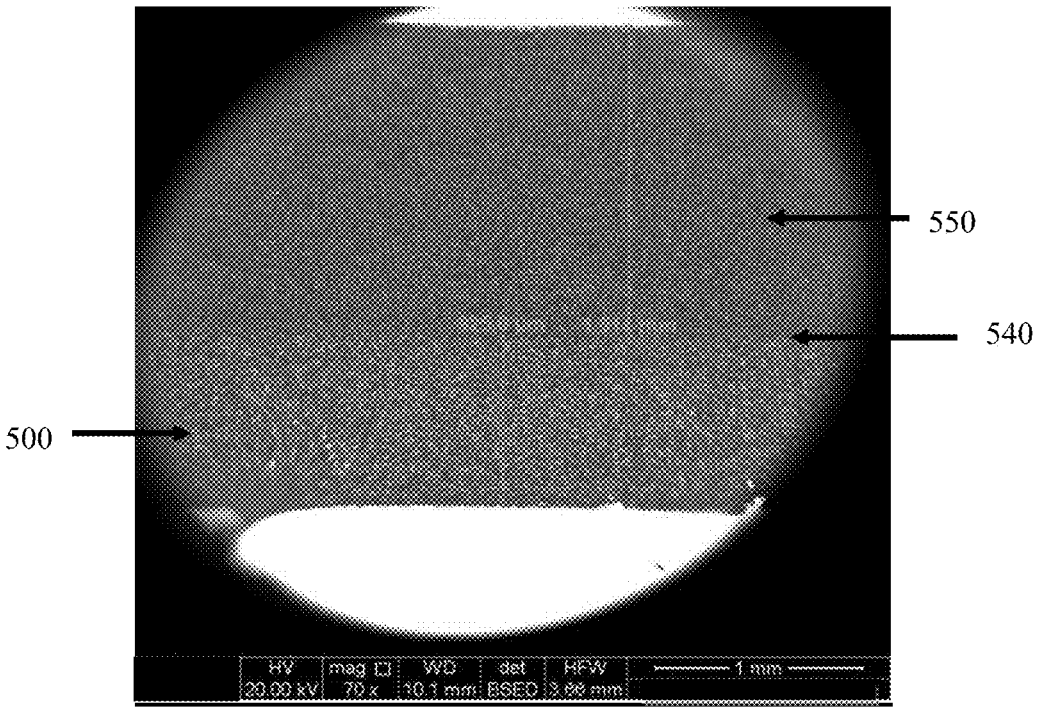
FIG. 6 shows a SEM image of a polycrystalline diamond body according to embodiments of the present disclosure.

Upon subjecting the assembly to a first HPHT sintering condition, the catalyst present in the transition layer melts and infiltrates through and into the diamond material, facilitating intercrystalline diamond bonding. During a second HPHT sintering condition, W—Co—C liquid (e.g., the attachment material) provided from the substrate may melt and infiltrate the transition layer a depth beyond the interface 540. During this infiltration and subsequent cool down, the PCD body becomes bonded to the substrate, thereby forming a cutting element having a PCD layer attached to the substrate. A PCD body was prepared according to the present embodiment. An SEM image of the PCD body prepared according to this embodiment, FIG. 6, shows the interface 540 between the polycrystalline diamond layer 550 and the transition layer 500, further providing evidence that bonding of the substrate occurs during the second sintering stage. The polycrystalline diamond body prepared according to the present embodiment (the use of a transition layer containing a refractory metal, or metal carbide, nitride, oxide, or boride substance) may contain a small amount of tungsten or other metal from the substrate on a surface of the polycrystalline diamond layer opposite the substrate, however, this amount is relatively less than is present at the surface of a conventional PCD body.

As mentioned above, according to various embodiments, the diamond material sintered and infiltrated according to the present disclosure may include a preformed sintered diamond body, such as a fully leached thermally stable polycrystalline (TSP) diamond wafer. Such a TSP diamond wafer may be formed by leaching out the catalyst material from a preformed polycrystalline diamond body and removing the substrate, if any, attached to the polycrystalline diamond body. The material microstructure of a TSP includes a first matrix phase of the bonded-together diamond grains and a second phase including a plurality of empty interstitial regions dispersed throughout the matrix phase. A TSP body is substantially free of the catalyst material used to initially form or sinter the diamond body. Further, as mentioned above, in embodiments using a preformed sintered diamond body, such as a TSP wafer, the material being infiltrated into the diamond body is referred to as an infiltrant material, as the diamond-to-diamond bonds are already formed (with use of a prior catalyst).

Figure 7:
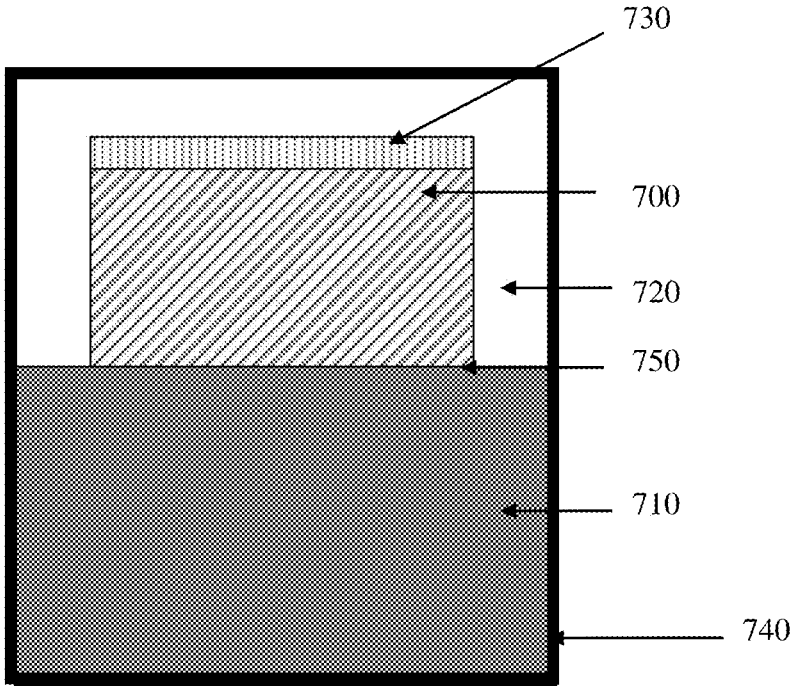
FIG. 7 shows a diagram for forming thermally stable polycrystalline diamond bodies according to embodiments of the present disclosure.

Referring now to FIG. 7, a substrate 710 is in a sintering container 740. A TSP wafer 700 is adjacent to the substrate 710. In some embodiments, the TSP wafer 700 has a smaller diameter than the substrate 710, while in others, the TSP wafer 700 and the substrate 710 have substantially the same diameter (e.g., the same diameter). An infiltrant material 730 having a diameter substantially equal (e.g., equal) to the TSP wafer is placed atop the TSP wafer 700. Diamond premixed with Co—WC may be placed between the TSP wafer 700 and the substrate 710. In one or more embodiments, the infiltrant material may be provided as a thin layer of cobalt powder or a foil, however, any suitable infiltrant material may be used. A supporting powder 720 may be placed within the sintering container, adjacent to the substrate 710, TSP wafer 700, and the infiltrant material layer 730, filling the volume of the sintering container 740. In one or more embodiments, the supporting powder is any material that does not react with the other components of the can. In some embodiments, boron nitride may be used as the supporting powder.

Upon subjecting the assembly to a first HPHT sintering condition, the infiltrant material 730 melts and infiltrates the pores (e.g., the plurality of empty interstitial regions dispersed throughout the diamond matrix phase) of the TSP wafer 700. As mentioned above, in one or more embodiments, the temperature of the first HPHT condition may range from about 1100° C. to about 1360° C., and upon reaching the desired temperature, the temperature may be held for a period of time, for example, of at least 15 seconds. However, the temperature and time are not limited, and any suitable temperature and time, such as those described throughout this disclosure, may be used. For example, the temperature and time may depend, for example, on the diamond density (and pore size) of the TSP wafer and may be varied depending on the extent of infiltration desired.

Figure 8:
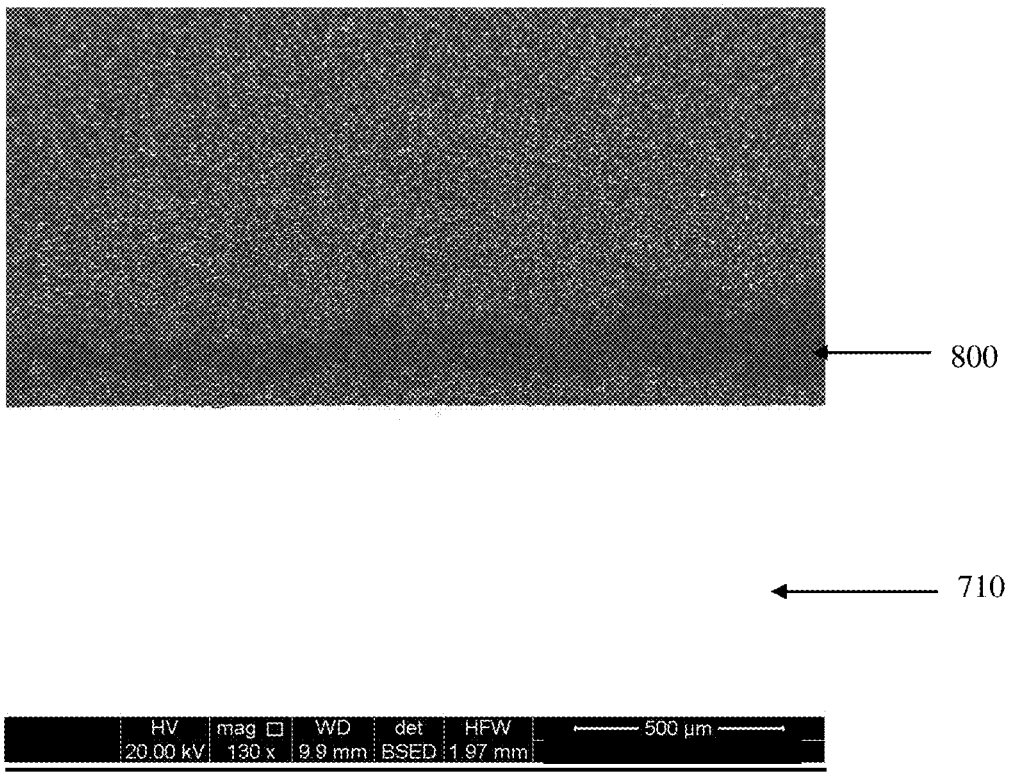
FIGS. 8 and 9 show SEM images of thermally stable polycrystalline diamond bodies according to embodiments of the present disclosure.

An assembly according to the embodiment shown in FIG. 7 was assembled and held at a HPHT sintering process of 1280° C. for 20 seconds. As seen in the SEM image shown in FIG. 8, a core of a TSP wafer was not infiltrated with the infiltrant material at these HPHT sintering conditions and appears as a dark area 800 above the substrate 710. However, when the temperature of the sintering condition was raised to 1300° C., and held at this temperature for 20 seconds, the TSP wafer was fully infiltrated with the infiltrant material. For the TSP wafer shown in the SEM of FIG. 8, because the temperature was too low, W—Co—C liquid provided from the substrate did not infiltrate into the fully leached TSP wafer. Accordingly, by selecting pressures, temperatures and times, the depth of the infiltration by the infiltrant may be controlled and adjusted to achieve a desired depth such as less than about 800 micrometers, without tungsten migration. According to various embodiments, the depth of the infiltration may range from about 50 micrometers to about 200 micrometers, or from about 50 micrometers to up to 80 micrometers, 90 micrometers, or 100 micrometers.

Figure 9:
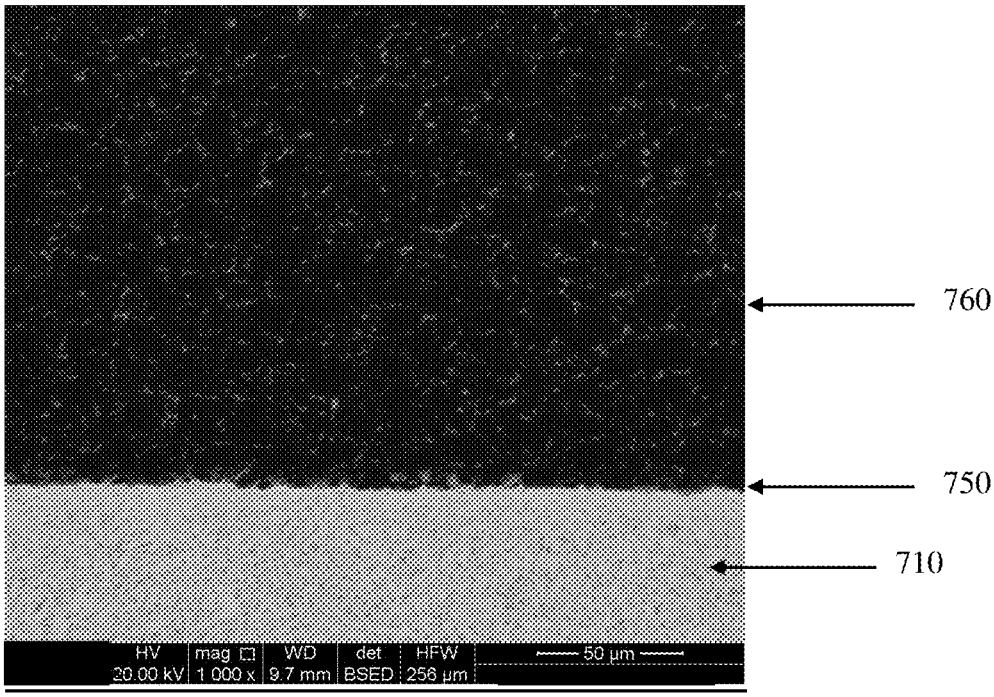

After this infiltration stage, the temperature is increased (subjecting the assembly to a second HPHT sintering condition) in order to improve the bonding strength between the substrate 710 and the TSP wafer 700, by causing liquid metal binder (e.g., attachment material) from the substrate to partially infiltrate into the diamond body, thereby bonding the two bodies together. The sintering temperature in the second stage may be greater than 1400° C., such as about 1450° C., for example. At this stage, diffusion of tungsten from the substrate into the PCD layer may be detected. An assembly according to the embodiment shown in FIG. 7 was processed according to this embodiment. A SEM image of the resulting PCD body is shown in FIG. 9. Specifically, FIG. 9 shows the infiltrated TSP wafer 760, the substrate 710, and the interface 750. Here, a W—Co—C liquid melted and diffused from the substrate 710 through the interface 750 and into the TSP wafer 760.

A PCD body formed according to the present embodiments, including the above-described embodiments, may be subjected to a leaching process whereby the catalyst or infiltrant material occupying the interstitial spaces between diamond bonded grains is removed from the diamond body, particularly at regions adjacent a working surface of the body. As used herein, the term "removed" refers to the reduced presence of a catalyst or infiltrant material in the diamond body, and is understood to mean that a substantial portion of the catalyst or infiltrant material no longer resides in at least a portion the diamond body. However, one skilled in the art would appreciate that the leaching process is limited in that trace amounts of catalyst or infiltrant material may still remain in the microstructure of the diamond body within the interstitial regions and/or adhered to the surface of the diamond grains. Such trace amounts may result from limited access of leaching agents during the leaching process, and because of this limited access, other methods may be used to reduce the thermal coefficient differential between the remaining catalyst material and diamond.

A common approach to remove or "leach" the catalyst or binder material from the diamond lattice structure is by treating diamond with strong acid solutions. This approach has been practiced on the entire diamond body, where the catalyst material has been removed from the entire diamond body, or has been practiced on a region of the diamond body. For example, an acid solution, such as nitric acid or combinations of several acids (such as nitric and hydrofluoric acid) may be used to treat the diamond table, removing at least a portion of the catalyst or infiltrant material from the diamond. Depending on the applications of the PCD, a select portion or region of the polycrystalline diamond may be leached, in order to gain thermal stability without losing impact resistance. In some embodiments, the region being leached may correspond to the region of the polycrystalline diamond having a low tungsten content. Depending on the extent of leaching desired, the entire region of the polycrystalline diamond having low tungsten, or a portion of the region having low tungsten may be leached.

Thus, according to some embodiments, the resulting microstructure of a leached cutting element may include a first region (at the working or upper surface of the body, remote from the substrate) having a network of intercrystalline bonded diamond grains and a plurality of first interstitial regions between the diamond grains that are substantially empty, a second region having a network of intercrystalline bonded diamond grains and a plurality of second interstitial regions filled with a catalyst or infiltrant and being substantially free of a refractory metal, and a third region (proximate a substrate) having a network of intercrystalline bonded diamond grains and a plurality of third interstitial regions between the diamond grains that are filled with a catalyst or infiltrant material and a refractory metal. The second region may be between the first and third regions. Other embodiments may include a microstructure with the first region and third region, and no second region. That is, the resulting microstructure of a leached cutting element may include a region (at the working or upper surface of the body, remote from the substrate) having a network of intercrystalline bonded diamond grains and a plurality of first interstitial regions between the diamond grains that are substantially empty, and a region (proximate a substrate) having a network of intercrystalline bonded diamond grains and a plurality of third interstitial regions between the diamond grains that are filled with a catalyst or infiltrant material and a refractory metal.

Figure 10:
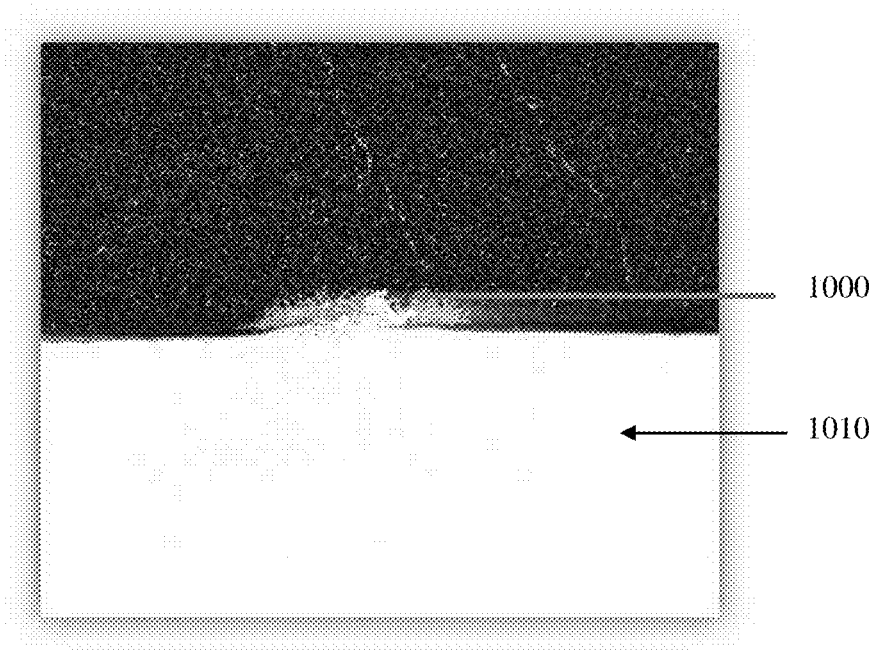
FIG. 10 shows a SEM image of a region taken of a conventional polycrystalline diamond body including substrate material eruptions.

In some embodiments, as a result of low infiltration temperature during the first stage of sintering (at the first sintering condition), eruptions at the interface of the substrate and the diamond body may be reduced or eliminated, especially for TSP rebonding. As used herein, "eruptions" refer to precipitated regions of carbide grains and binder pools (catalyst or infiltrant material) in the polycrystalline diamond formed from the substrate material that create large carbide grain growth regions and/or inclusions that are substantially larger than the interstitial regions formed in a polycrystalline diamond body. For example, the eruptions may be at least an order of magnitude larger than conventional interstitial regions. Eruptions may occur during HPHT bonding methods of attaching a diamond body to a substrate without pressure control, where the eruptions precipitate from the substrate into the diamond body. FIG. 10 shows for example a conventional PCD body with a non-uniform structure due to eruptions 1000 in the diamond body provided from the substrate 1010. In comparison, FIG. 9 shows a TSP wafer attached to a substrate using a two-stage infiltration, resulting in a body being substantially free of eruptions.

In some embodiments, because a relatively low amount of tungsten or other refractory metal is present near the working surface of the diamond body, less time may be needed to leach the resultant diamond body compared with the leaching of conventional PCDs. The leaching process of a conventional PCD may be difficult and lengthy when a large amount of W—Co—C liquid is infiltrated into the diamond layer. For example, for a first leaching depth in a conventional PCD that may be achieved in about a week, the same leaching depth may be achieved in 1-3 days for polycrystalline diamond bodies according to embodiments of the present disclosure. In addition, in some embodiments, because tungsten is not present in the working region of the diamond body (e.g., the desired leaching depth), the leaching process may not require hydrofluoric acid, thereby being safer and more environmentally friendly.

It is also within the scope of the present disclosure that HPHT sintering methods as disclosed herein may be used for cutting elements having a non-planar upper surface (e.g., working surface opposite the substrate), such as polycrystalline diamond enhanced inserts (DEIs). In particular, inserts of the present disclosure may have a substrate, a working layer of PCD material forming the working surface of the insert, and at least one transition layer in between.

A conventional DEI typically includes a cemented tungsten carbide body as a substrate and a layer of PCD directly bonded to the tungsten carbide substrate on the top portion of the insert, with one or more transition layers. However, conventional DEIs sometimes suffer from internal stresses due to the manufacturing process which result in delamination problems. As such, due to stiffness constraints, DEIs are mostly sintered on carbide substrates containing a relatively low cobalt content, making it difficult to fully infiltrate the PCD layer at a reasonable sintering temperature. Thus, a certain amount of cobalt may be blended in the diamond mix used for the DEI sintering. However, the addition of cobalt in the diamond layer may reduce the wear resistance of the sintered PCD.

According to embodiments of the present disclosure, the fracture toughness of DEIs may be improved by infiltrating the polycrystalline diamond working layer with an infiltrant material such as cobalt provided from a transition layer during a two stage HPHT sintering process (as compared to a single stage process used to make conventional DEIs), as well as through consideration of the layer thickness ratio of the diamond layer and the transition layer. For example, DEIs with a multi-layer design may be formed by using a working diamond layer not premixed with a catalyst, such as cobalt, and at least one transition layer, adjacent to the working layer and/or the substrate, containing catalyst premixed with diamond powder. In one or more embodiments, the amount of the catalyst material premixed in the transition layer ranges from about 10 wt % to about 70 wt % based on the total weight of the transition layer. Various other ranges such as from about 10 wt % to about 30 wt %, or from about 20 wt % to about 40 wt % may be used. The insert may be sintered according to the methods described above by holding the HPHT sintering at a first stage (with a first sintering condition) to infiltrate the diamond material with the catalyst provided from the transition layer prior to ramping to a second stage (at a second sintering condition) at which point the metal provided in the substrate may infiltrate into the diamond. According to some embodiments, by optimizing or improving the mechanical properties of such polycrystalline diamond enhanced inserts, particularly the fracture toughness, the survivability rate of the insert during drilling may be improved.

Figure 11:
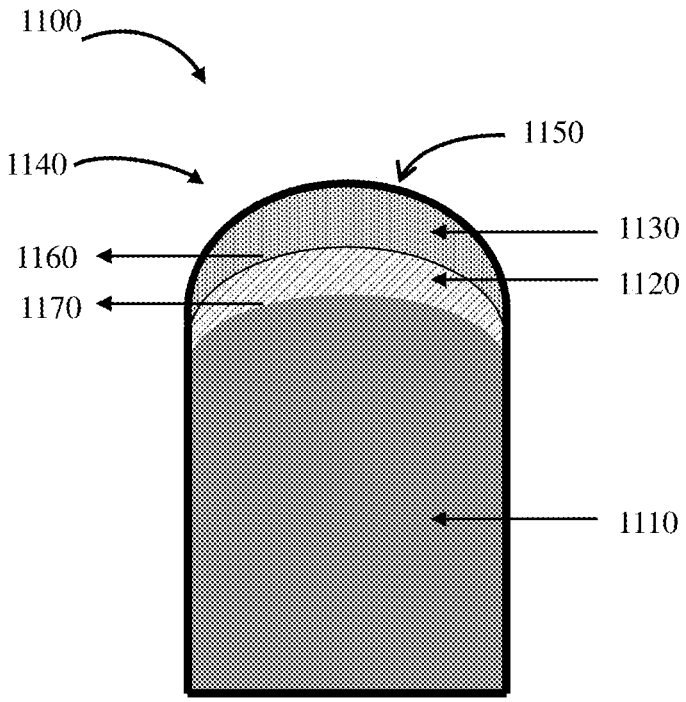
FIG. 11 shows a diagram for forming a polycrystalline diamond enhanced insert according to embodiments of the present disclosure.

For example, referring to FIG. 11, an insert assembly 1100 according to the present disclosure includes a working layer 1130 made of diamond, a substrate 1110, and at least one transition layer 1120 therebetween. The transition layer includes diamond powder premixed with a catalyst. The working layer 1130 is disposed at the uppermost end 1140 of the insert assembly 1100 and forms the working or cutting surface 1150 of the insert assembly 1100. According to various embodiments, the diamond material used to form the working layer 1130 may be substantially free of catalyst or may contain less than 3 wt % premixed catalyst, such as cobalt. As shown, the insert assembly 1100 has one transition layer 1120 between and adjacent to both the working layer 1130 and the substrate 1110, however multiple transition layers may be used. A working layer/transition layer interface 1160 is formed between the working layer 1130 and the transition layer 1120, and a transition layer/substrate interface 1170 is formed between the transition layer 1120 and the substrate 1110.

Upon subjecting the assembly 1100 to a first HPHT sintering condition, the catalyst present in the transition layer 1120 melts and infiltrates into the diamond layer 1130, facilitating intercrystalline diamond bonding. After holding the temperature at the first HPHT sintering condition for a period of time, the temperature may be raised to a second HPHT sintering condition, as discussed above, whereupon W—C—Co liquid provided from the substrate 1110 (e.g., attachment material) may melt and infiltrate into the transition layer a depth along the interface 1170, facilitating the attachment of the PCD to the substrate thereby forming a cutting element having a polycrystalline diamond layer attached to the substrate through a transition layer. The first and second HPHT sintering conditions may be any of those described in the present disclosure.

Figure 12:
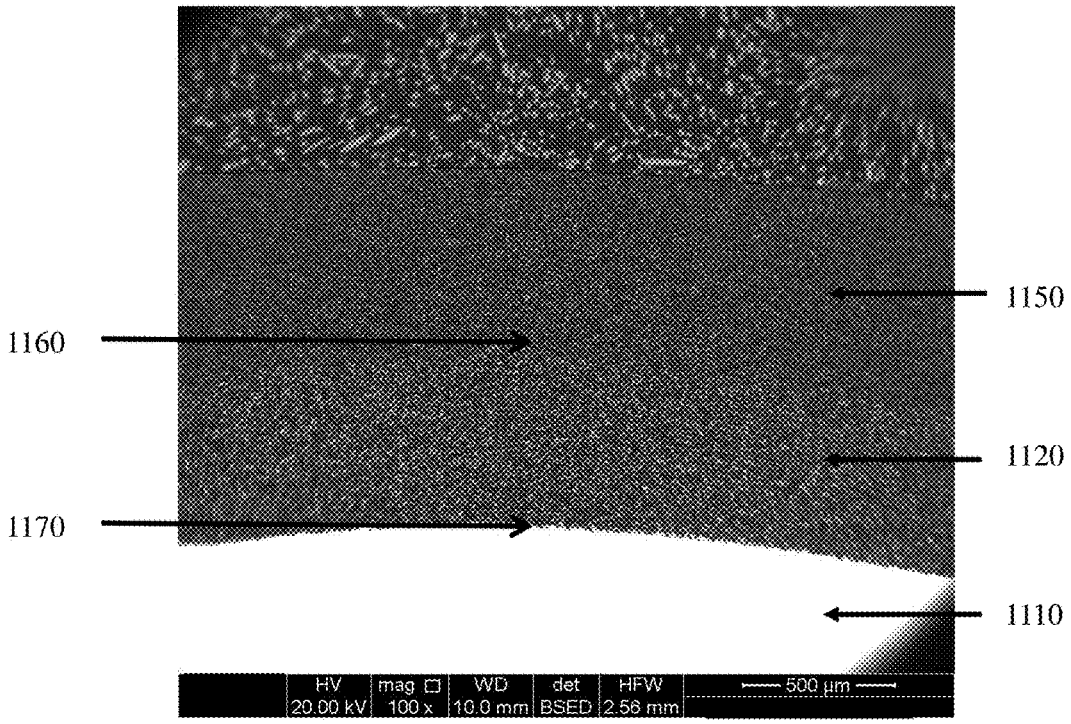
FIGS. 12 and 13 show SEM images of polycrystalline diamond enhanced inserts according to embodiments of the present disclosure.
Figure 13:
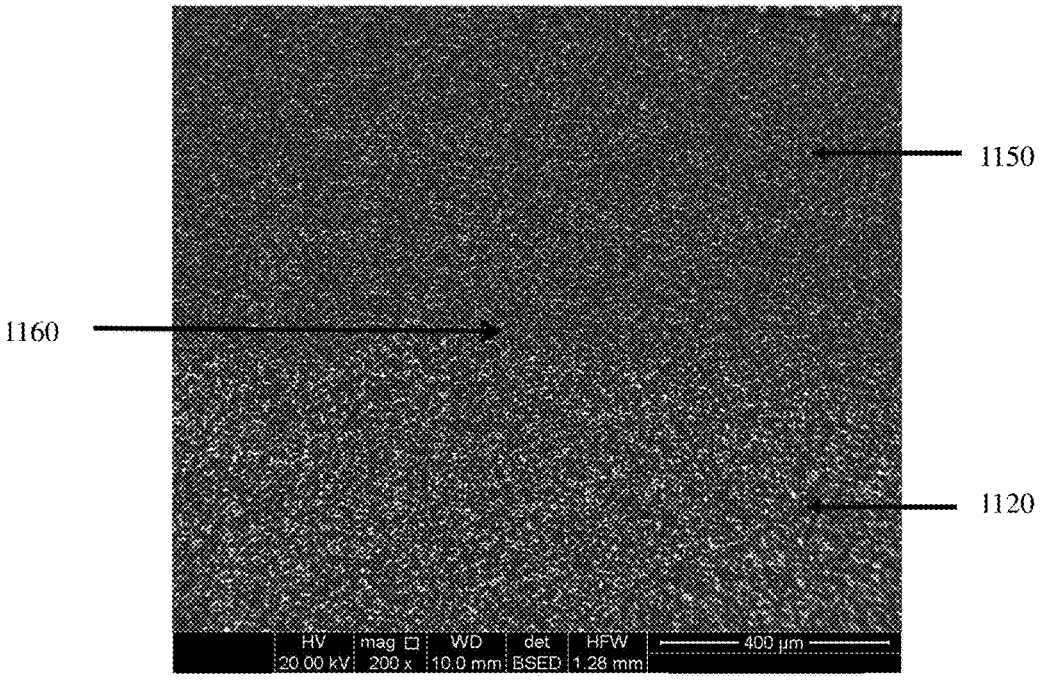

A DEI was formed according to the present embodiment. As seen in FIGS. 12 and 13, the SEM images taken at different magnifications of the DEI show that the resulting layers have different microstructures due to a different WC content between the working PCD layer 1150 and the adjacent transition layer 1120. In the bilayer PCD microstructure resulting after the sintering process, the working layer 1150 contains less tungsten than the transition layer. For example, the working layer 1150 may contain less than 2 wt % tungsten, less than 1 wt % tungsten, or less than 0.5 wt % tungsten, while the transition layer 1120 may contain more than 0.5 wt % tungsten, more than 1 wt % tungsten, or more than 2 wt % tungsten (e.g., up to a maximum of 3 wt % tungsten, 5 wt % tungsten, or 10 wt % tungsten).

Diamond particles useful for forming polycrystalline diamond bodies according to the present disclosure may include any type of diamond particle, including natural or synthetic diamond powders having a wide range of particle sizes. For example, such diamond powders may have an average particle size ranging from micrometer to nanometer size. Further, the diamond powder used may include particles having a mono-modal or multi-modal distribution.

According to various embodiments, following the formation of intercrystalline bonding, a polycrystalline diamond body may be formed that has, in one embodiment, at least about 80 percent by volume diamond, with the remaining balance of the interstitial regions between the diamond grains occupied by the infiltrant material. In other embodiments, the diamond body may have at least 85 percent by volume diamond, at least 90 percent by volume diamond, or at least 95 percent by volume diamond. However, one skilled in the art would appreciate that other diamond densities may be used in other embodiments. Thus, the polycrystalline diamond bodies being used in accordance with the present disclosure include what is frequently referred to in the art as "high density" polycrystalline diamond (e.g., 97 percent by volume diamond or higher).

Substrates of the present disclosure may include wear resistant material having hard particles dispersed in a binder metal matrix. An example substrate material may include tungsten carbide particles dispersed in a cobalt binder, such as cobalt cemented tungsten carbide (WC/Co). Such substrate materials include a hard particle phase made of tungsten carbide particles and a metal binder phase made of cobalt. Other suitable materials for the substrate include, without limitation, metals, ceramics, and or other cemented carbides. Suitable binder materials include Group VIII metals of the Periodic table or alloys thereof, including iron, nickel, cobalt, or alloys thereof.

In some embodiments, PCD bodies infiltrated with a catalyst or infiltrant originating from a source other than a substrate in a two stage sintering process, as described herein, have improved fracture toughness compared with conventional PCD bodies formed with a catalyst or infiltrant from the substrate. Shown in Table 1 below is a comparative analysis of the fracture toughness of PCD bodies prepared from three different diamond grades in accordance with embodiments of the present disclosure, as well as conventional PCD (where cobalt infiltrates solely from the substrate). The fracture toughness was measured for leached and non-leached PCD bodies for each infiltration source. As seen in the examples provided, PCD bodies prepared in accordance with the present disclosure have improved fracture toughness compared with conventional PCD bodies. In addition, the leached PCD bodies of the present disclosure have improved fracture toughness even over unleached PCD bodies of the same grade formed with a conventional sintering and infiltration process. This data shows that the increased amount of tungsten (for the conventional samples, relative to the samples formed in accordance with the present disclosure) in the interstitial regions has an effect on the unleached elements, as well as on the body after leaching.

TABLE 1

| Grade | Infiltration source | Conditions | K1c (MPa · $m^{1/2}$) |
|---|---|---|---|
| A | Pure cobalt infiltrated | Leached | 9.6 ± 0.7 |
| | from top | Non-Leached | 12.3 ± 0.6 |
| | Carbide substrate | Leached | 5.9 ± 0.7 |
| | | Non-Leached | 7.4 ± 0.2 |
| B | Pure cobalt infiltrated | Leached | 8.7 ± 0.1 |
| | from top | Non-Leached | 10.0 ± 0.6 |
| | Carbide substrate | Leached | 5.2 ± 0.3 |
| | | Non-Leached | 7.5 ± 0.9 |
| C | Pure cobalt infiltrated | Leached | 8.3 ± 0.2 |
| | from top | Non-Leached | 9.7 ± 0.5 |
| | Carbide substrate | Leached | N/A |
| | | Non-Leached | 4.3 ± 0.2 |

Figure 14:
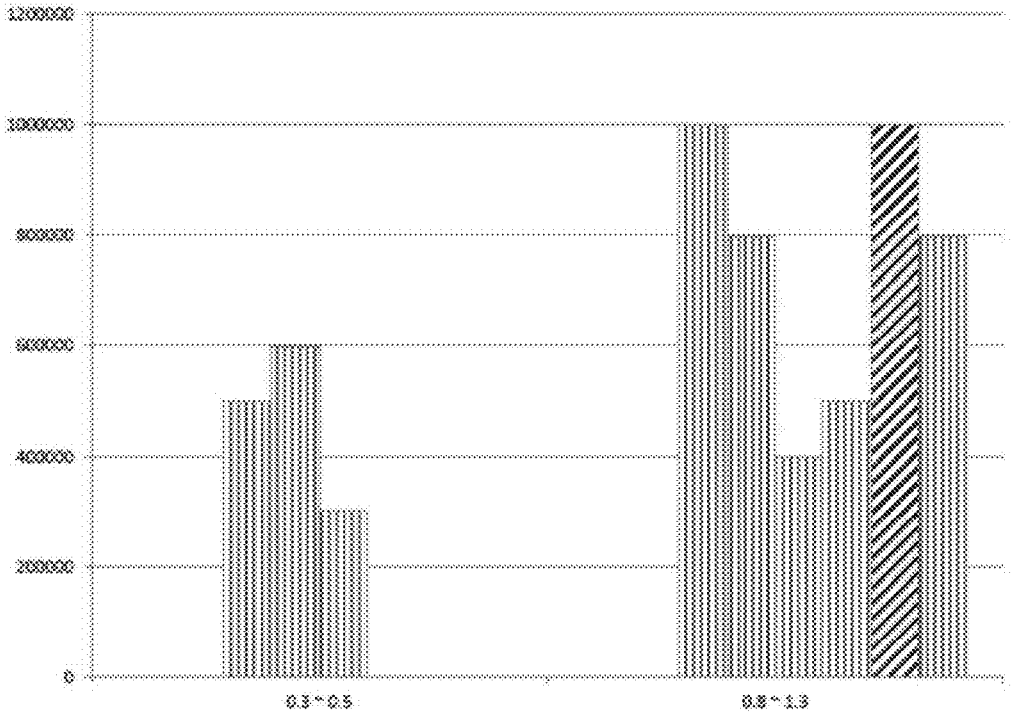
FIG. 14 shows the fatigue life of polycrystalline diamond enhanced inserts according to embodiments of the present disclosure.

In some embodiments, the fracture toughness may also be improved by adjusting the layer thickness ratio between the top working layer and the transition layer. For example, the experimental data provided in FIG. 14 shows the influence of the layer thickness ratio on the fracture toughness. The columns with the light vertical bars refer to insert failure life cycle, while the columns with the angled bars indicate that the insert survived 1 million cycles of test. The data was obtained using a high frequency compressive fatigue test performed at a frequency of 20 Hz, and a compressive force of 22 KIP. The standard baseline average fatigue life is 433,333. As seen in FIG. 14, the fracture toughness increases as the layer thickness ratio of the working layer to the transition layer increases. According to embodiments of the present disclosure, the working layer and the transition layer may be selected to have a layer thickness ratio ranging from about 0.75:1 to about 2.5:1, from about 0.8:1 to about 2.4:1, from about 0.9:1 to about 2.3:1, or from about 1:1 to 2:2.

Polycrystalline diamond bodies made according to embodiments of the present disclosure may be used in a number of different applications, such as tools for mining and cutting applications, where the combined properties of thermal stability, strength/toughness, and wear and abrasion resistance are highly desired. As such, polycrystalline diamond bodies of the present disclosure are suited for use as cutting elements on downhole drill bits such as roller cone rock bits, percussion or hammer drill bits, and drag bits used for drilling subterranean formations.

Figure 15:
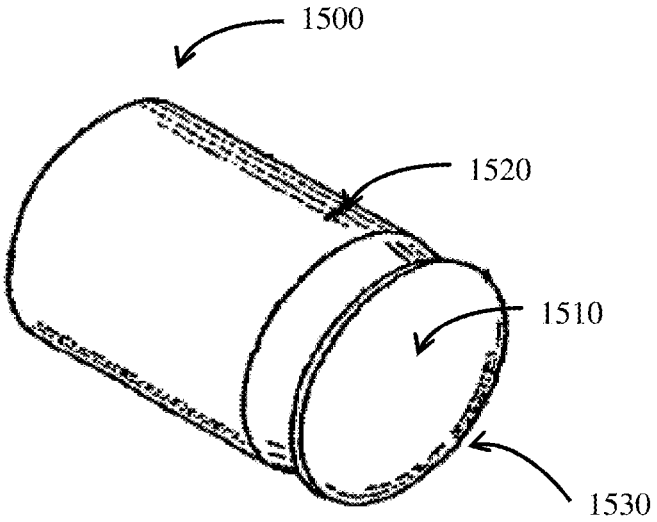
FIG. 15 is a schematic perspective side view of a diamond shear cutter made according to embodiments of the present disclosure.

For example, FIG. 15 illustrates a polycrystalline diamond body of this disclosure as embodied in the form of a shear cutter 1500 used, for example, with a drag bit for drilling subterranean formations. The shear cutter 1500 includes a diamond-bonded body 1510 that is sintered or otherwise attached to a cutter substrate 1520. The diamond-bonded body 1510 includes a working or cutting surface 1530.

Figure 16:
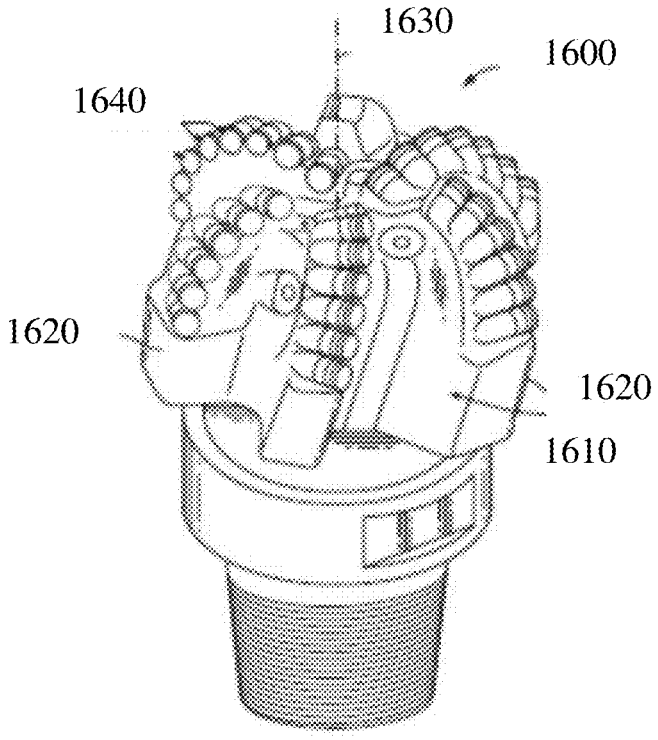
FIG. 16 shows a perspective side view of a rotary drill bit having cutting elements according to embodiments of the present disclosure.

FIG. 16 illustrates a drag bit 1600 having a bit body 1610. The lower face of the bit body 1610 is formed with a plurality of blades 1620, which extend generally outwardly away from a central longitudinal axis of rotation 1630 of the drill bit. A plurality of the PDC shear cutters 1640, described above and illustrated in FIG. 16, are attached to the blades 1620 for cutting a subterranean formation being drilled. The number of PDC cutters 1600 carried by each blade and carried by the bit may vary.

Figure 17:
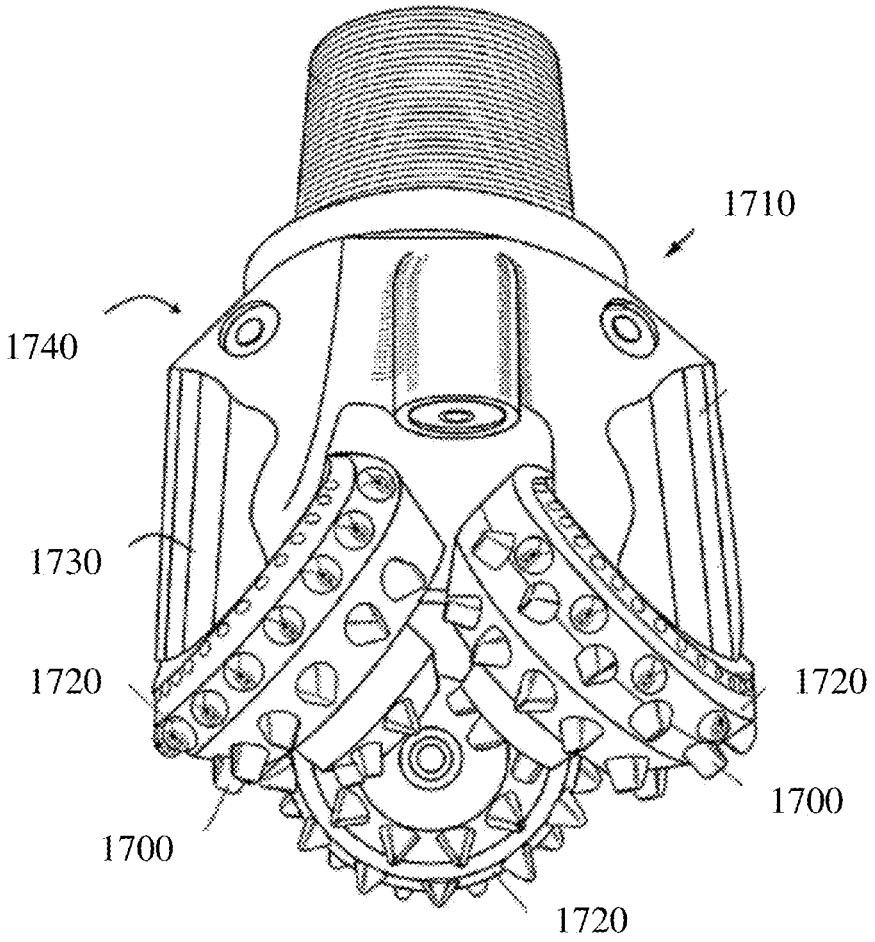
FIG. 17 shows perspective side view of a roller cone drill bit having inserts made according to embodiments of the present disclosure.
Figure 18:
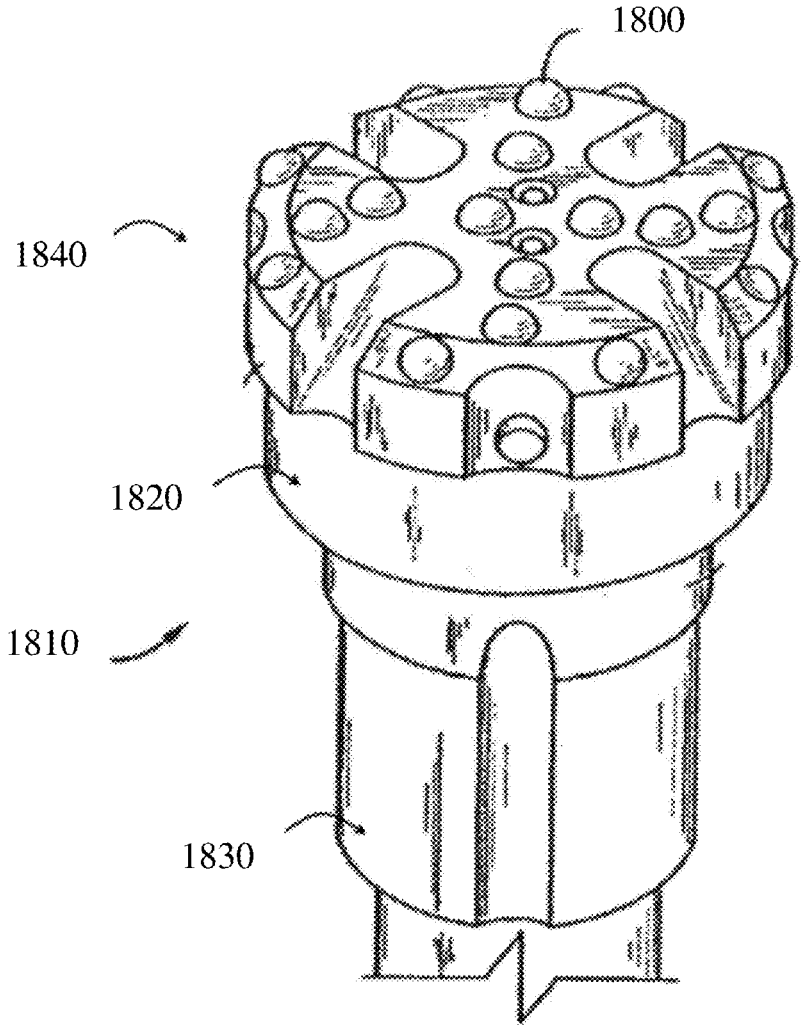
FIG. 18 shows a perspective side view percussion or hammer bit having inserts made according to embodiments of the present disclosure.

Polycrystalline diamond enhanced inserts of the present disclosure may be used with roller cone drill bits or percussion or hammer drill bits. For example, FIG. 17 illustrates a roller cone drill bit 1710 including a number of the wear or cutting inserts 1700 described above. The roller cone drill bit 1710 has a body 1740 with three legs 1730, and a roller cone 1720 mounted on a lower end of each leg 1730. The inserts 1700 fabricated according to the present disclosure are provided in the surfaces of each cone 1720 for bearing on the subterranean formation being drilled. Referring now to FIG. 18, inserts 1800 described above may be mounted to a percussion or hammer bit 1810. The hammer bit 1810 has a hollow steel body 1820 with a pin 1830 on an end of the body for assembling the bit onto a drill string and a head end 1840 of the body. A plurality of inserts 1800 may be provided in the surface of the head end for bearing on and cutting the formation to be drilled.

According to some embodiments of the present disclosure include a method of making polycrystalline diamond bodies with improved fracture toughness by infiltrating the diamond layer with an infiltrant material not provided from the substrate. Upon sintering, the infiltrant material infiltrates the diamond layer before the infiltration of materials from the substrate. This reduces the extent of infiltration of the refractory metals such as tungsten from the substrate into the diamond body. By reducing the amount of tungsten residing in the interstitial regions (particularly at or near the working surface) a faster leaching process may occur, which in turns lowers manufacturing cost. Additionally, as the sintering of the PCD bodies according to the present embodiments does not depend on the infiltration of W—Co—C liquid from the substrate, a broader selection of carbide materials may be available for use, improving the sintering yield. In addition, the use of the catalyst or infiltrant material that infiltrates into the diamond layer before the infiltration of the W—Co—C provided from the substrate, as disclosed herein, may reduce the appearance of eruptions that may occur at the substrate/diamond interface.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

What is claimed is:

1. A method of forming a polycrystalline diamond cutting element, comprising:

assembling a diamond material, a substrate, and a source of catalyst material or infiltrant material distinct from the substrate, the source of catalyst material or infiltrant material being adjacent to the diamond material to form an assembly, the substrate comprising an attachment material comprising a refractory metal, and the diamond material comprising diamond powder;

subjecting the assembly to a first high-pressure/high-temperature condition to cause the catalyst material or infiltrant material to melt and infiltrate into the diamond material; and subjecting the assembly to a second high-pressure/high-temperature condition to cause the attachment material to melt and infiltrate a portion of the infiltrated diamond material to attach the infiltrated diamond material to the substrate.

2. The method of claim 1, wherein the attachment material comprises metal carbide particles and metal binder.

3. The method of claim 1, wherein the substrate comprises tungsten carbide grains bonded together by a cobalt binder.

4. The method of claim 1, wherein the catalyst material or infiltrant material infiltrates into the diamond material before the attachment material infiltrates into the diamond material.

5. The method of claim 1, wherein the temperature of the second high-pressure/high-temperature condition is higher than the temperature of the first high-pressure/high-temperature condition.

6. The method of claim 1, wherein the first high-pressure/high-temperature condition comprises a temperature of about 1100° C. to about 1360° C., and the second high-pressure/high-temperature condition comprises a temperature from about 1300° C. to about 1600° C.

7. The method of claim 1, further comprising holding the first high-pressure/high-temperature condition for about 0.1 minutes to about 10 minutes prior to the second high-pressure/high-temperature condition.

8. The method of claim 1, wherein the source of catalyst material or infiltrant material distinct from the substrate comprises a transition layer comprising a mixture of catalyst material and diamond powder placed between the diamond material and the substrate.

9. The method of claim 8, wherein the catalyst material is included at about 10 wt % to about 70 wt % based on the total weight of the transition layer.

10. The method of claim 1, wherein the source of catalyst material or infiltrant material comprises metal foil or metal powder placed adjacent to the diamond material opposite the substrate.

11. The method of claim 1, wherein the catalyst material or infiltrant material comprises a metal or a metal alloy including an element from Group VIII of the Periodic Table.

12. The method of claim 11, wherein the catalyst material or infiltrant material comprises cobalt.

13. The method of claim 1, wherein after the second high-pressure/high-temperature condition, a region of the infiltrated diamond material opposite the substrate includes less than 1.0 wt % refractory metal based on the total weight of the region.

* * * * *